US009281553B2

(12) United States Patent
Tsai et al.

(10) Patent No.: US 9,281,553 B2
(45) Date of Patent: Mar. 8, 2016

(54) WEARABLE DEVICE

(71) Applicant: Wistron Corporation, New Taipei (TW)

(72) Inventors: Wen-Yi Tsai, New Taipei (TW); Chia-Ching Lee, New Taipei (TW)

(73) Assignee: Wistron Corporation, New Taipei (TW)

( * ) Notice: Subject to any disclaimer, the term of this patent is extended or adjusted under 35 U.S.C. 154(b) by 58 days.

(21) Appl. No.: 14/301,345

(22) Filed: Jun. 11, 2014

(65) Prior Publication Data

US 2015/0255855 A1 Sep. 10, 2015

(30) Foreign Application Priority Data

Mar. 5, 2014 (TW) ..... 103107456 A

(51) Int. Cl.

| | |
|---|---|
| ***H01Q 1/24*** | (2006.01) |
| ***H01Q 1/12*** | (2006.01) |
| ***G04R 60/06*** | (2013.01) |
| ***H01Q 1/27*** | (2006.01) |
| ***H01Q 13/10*** | (2006.01) |

(52) U.S. Cl.

CPC ..... *H01Q 1/243* (2013.01); *G04R 60/06* (2013.01); *H01Q 1/273* (2013.01); *H01Q 13/10* (2013.01)

(58) Field of Classification Search

USPC ..... 343/702, 718

See application file for complete search history.

(56) References Cited

U.S. PATENT DOCUMENTS

| | | | | |
|---|---|---|---|---|
| 5,589,840 | A * | 12/1996 | Fujisawa | H01Q 1/273 343/718 |
| 5,627,552 | A * | 5/1997 | Farrar | G04G 21/04 343/718 |
| 6,853,605 | B2 * | 2/2005 | Fujisawa | G04B 37/0008 235/487 |
| 2013/0016016 | A1 | 1/2013 | Lin et al. | |
| 2015/0070226 | A1 * | 3/2015 | Wong | H01Q 1/273 343/718 |

* cited by examiner

*Primary Examiner* — Tan Ho

(74) *Attorney, Agent, or Firm* — Jianq Chyun IP Office

(57) ABSTRACT

A wearable device including a display unit, a conductive frame and a belt-like structure is provided. The conductive frame surrounds a display region of the display unit, and the conductive frame has a first open slot. Besides, a feeding point and a first ground point are disposed on two sides of an opening of the first open slot, and the conductive frame forms a first antenna element. The belt-like structure is respectively connected to a first edge and a second edge, which are opposite to each other, of the conductive frame.

14 Claims, 7 Drawing Sheets

WEARABLE DEVICE

CROSS-REFERENCE TO RELATED APPLICATION

This application claims the priority benefit of Taiwan application serial no. 103107456, filed on Mar. 5, 2014. The entirety of the above-mentioned patent application is hereby incorporated by reference herein and made a part of this specification.

BACKGROUND OF THE INVENTION

1. Field of the Invention

The invention relates to a wearable device, and particularly relates to a wearable device with an antenna element formed by a conductive frame.

2. Description of Related Art

With the rapid development of mobile communication technology, the research and development related to integrating the mobile communication function into wearable devices (e.g. smart watches, smart glasses, etc.) are now very popular and prosperous. Due to the feature of being easy to wear, the hardware space of the wearable devices tends to be limited. Accordingly, the space for disposing an antenna element in the wearable devices is even more limited. However, the antenna element requires an appropriate size to achieve the required radiation characteristic. Thus, how to design the antenna element in the limited space of wearable devices to maintain the convenience of wearing the wearable devices is now an issue for the manufactures to work on.

SUMMARY OF THE INVENTION

The invention provides a wearable device adapted to use a conductive frame to form an antenna element. Therefore, a hardware space of the wearable device is reduced, and a convenience of wearing the wearable device is improved.

The wearable device of the invention includes a display unit, the conductive frame, and a belt-like structure. In addition, the conductive frame surrounds a display region of the display unit, and has a first open slot. Besides, a feeding point and a first ground point are disposed at two sides of an opening of the first open slot, and the conductive frame forms a first antenna element. The belt-like structure is respectively connected to a first edge and a second edge of the conductive frame, and the first edge and the second edge are opposite to each other.

Based on the above, the wearable device of the invention uses the conductive frame to form the first antenna element, and uses the conductive frame and a microstrip line to form the second antenna element. Therefore, it is not necessary for the wearable device to be additionally disposed with an independent space to accommodate an antenna element. Moreover, a hardware space of the wearable device may be reduced, and a convenience of wearing the wearable device is thus improved.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
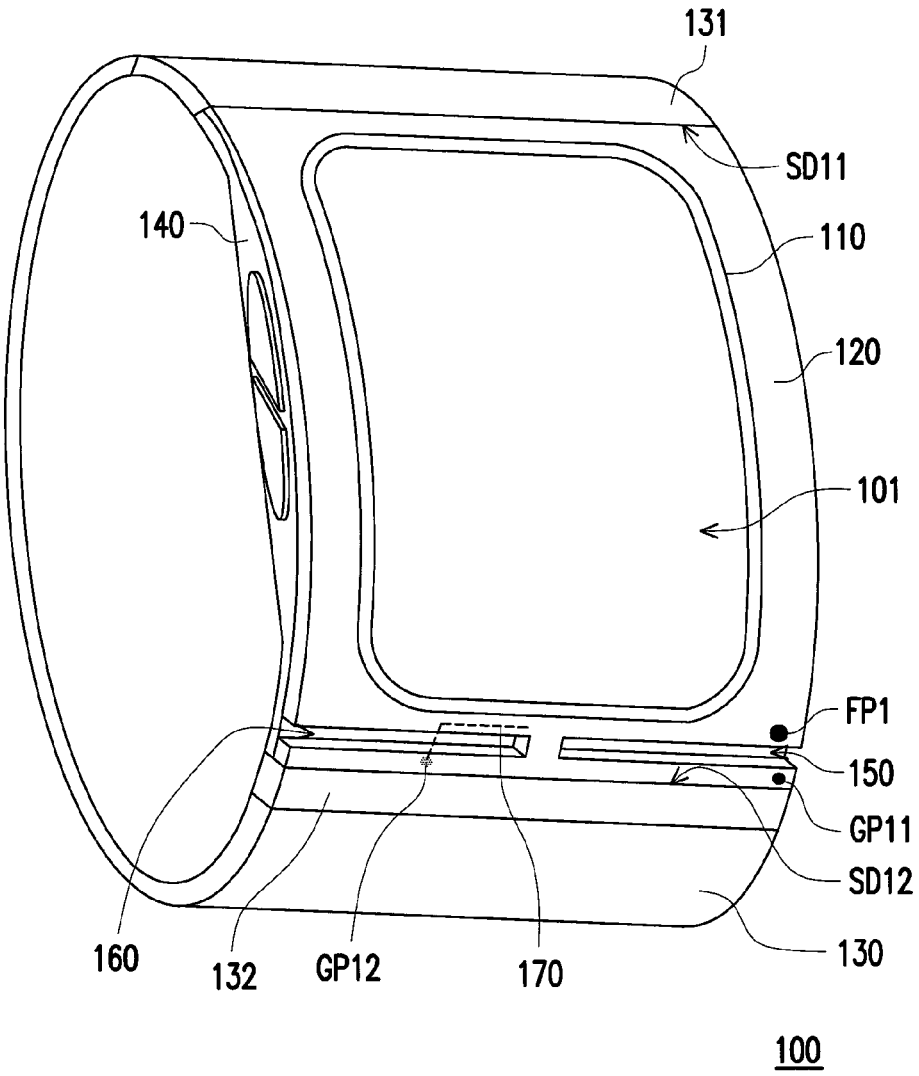
FIG. 1 is a schematic view illustrating a wearable device according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic view illustrating a wearable device according to an embodiment of the invention. Referring to FIG. 1, a wearable device 100 includes a display unit 110, a conductive frame 120, a belt-like structure 130, and a device body 140. In addition, the display unit 110 and the conductive frame 120 are disposed on the device body 140. Also, the conductive frame 120 surrounds a display region 101 of the display unit 110, and the conductive frame 120 is a part of a housing of the wearable device 100. The belt-like structure 130 is respectively connected to a first edge SD11 and a second edge SD12 of the conductive frame 120, and the first edge SD11 and the second edge SD12 are opposite to each other. In this way, the user may wear the wearable device 100 on the wrist, for example, with the belt-like structure 130, so that the wearable device 100 is convenient to be used and carried.

The belt-like structure 130 may be composed of a conductive material or a non-conductive material. In addition, to connect the belt-like structure 130 and the conductive frame 120, the wearable device 100 in one embodiment further includes a first connecting element 131 and a second connecting element 132. The first connecting element 131 is disposed between the belt-like structure 130 and the first edge SD11 of the conductive frame 120, and the second connecting element 132 is disposed between the belt-like structure 130 and the second edge SD12 of the conductive frame 120.

It should be noted that the conductive frame 120 has a first open slot 150, and a feeding point FP1 and a ground point GP11 are disposed at two sides of an opening of the first open slot 150. In this way, the conductive frame 120 may form a first antenna element, such as a planar inverted-F antenna (PIFA). Thus, the wearable device 100 is operated in a first frequency band and a second frequency band. For example, the feeding point FP1 may receive a feeding signal from a communication module (not shown) in the wearable device 100, and the ground point GP1 is electrically connected to a ground plane of the wearable device 100. With excitation of the feeding signal, the conductive frame 120 may generate an excitation mode that covers the first frequency band and the second frequency band. Accordingly, the wearable device 100 is operated in the first frequency band and the second frequency band.

Furthermore, the conductive frame 120 further has a second open slot 160, and the wearable device 100 further includes a microstrip line 170. In addition, the microstrip line 170 is opposite to the second open slot 160 and has a second ground point GP12. In this way, the microstrip line 170 and the conductive frame 120 may form a second antenna element, such as a coupled monopole antenna, and the wearable device 100 is thus operated in a third frequency band. For example, the feeding signal from the feeding point FP1 may be coupled to the microstrip line 170 through the second open slot 160. Thus, the microstrip line 170 and the conductive frame 120 may generate an excitation mode that covers the third frequency band, and the wearable device 100 is thus operated in the third frequency band.

Figure 2:
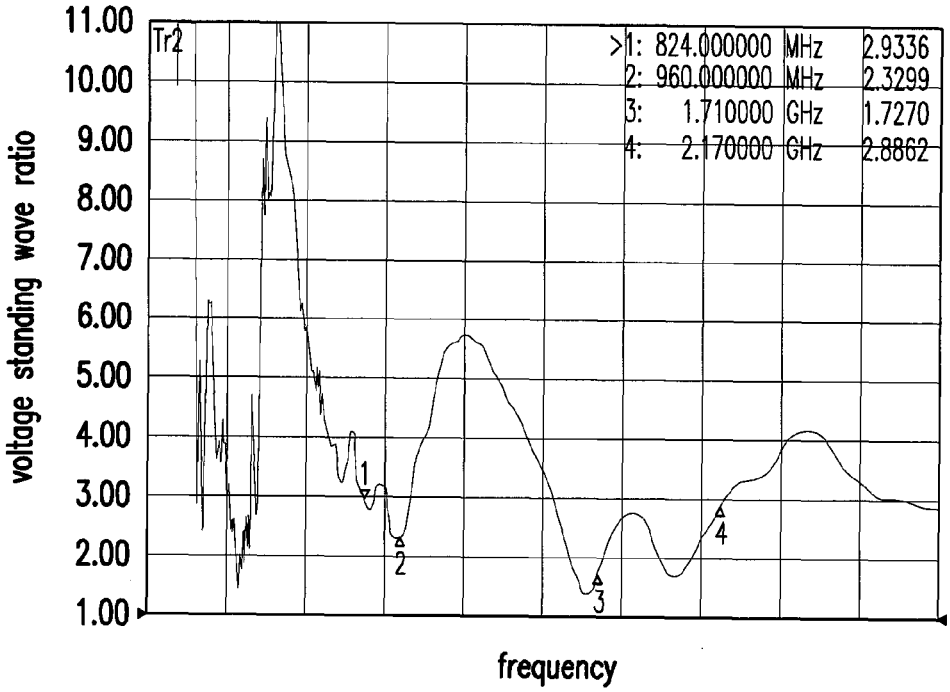
FIG. 2 is a view illustrating a voltage standing wave ratio (VSWR) of a first antenna element according to an embodiment of the invention.
Figure 3:
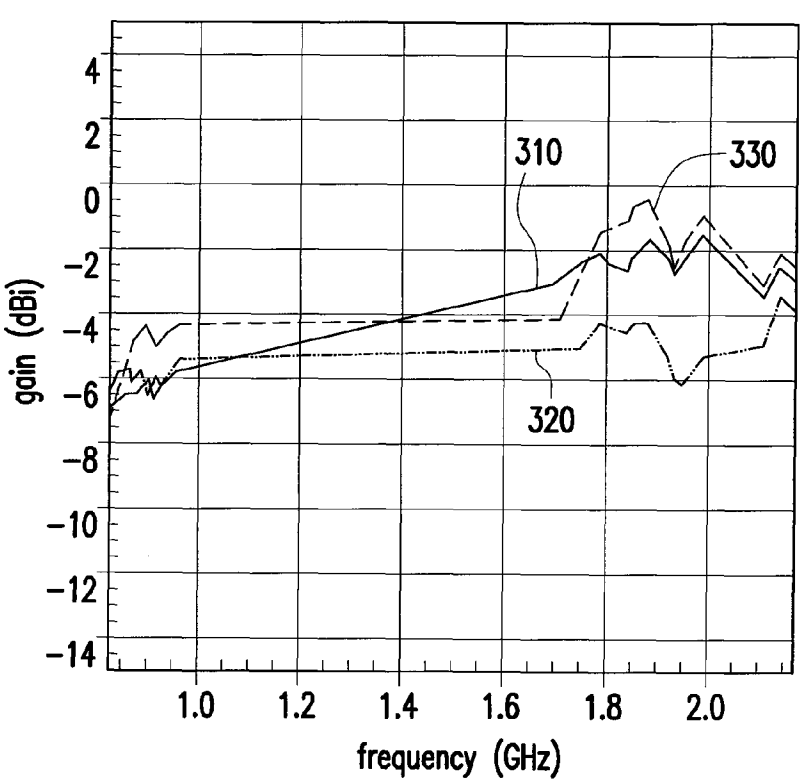
FIG. 3 is a view illustrating a radiation efficiency and gain of the first antenna element according to an embodiment of the invention.
Figure 3:
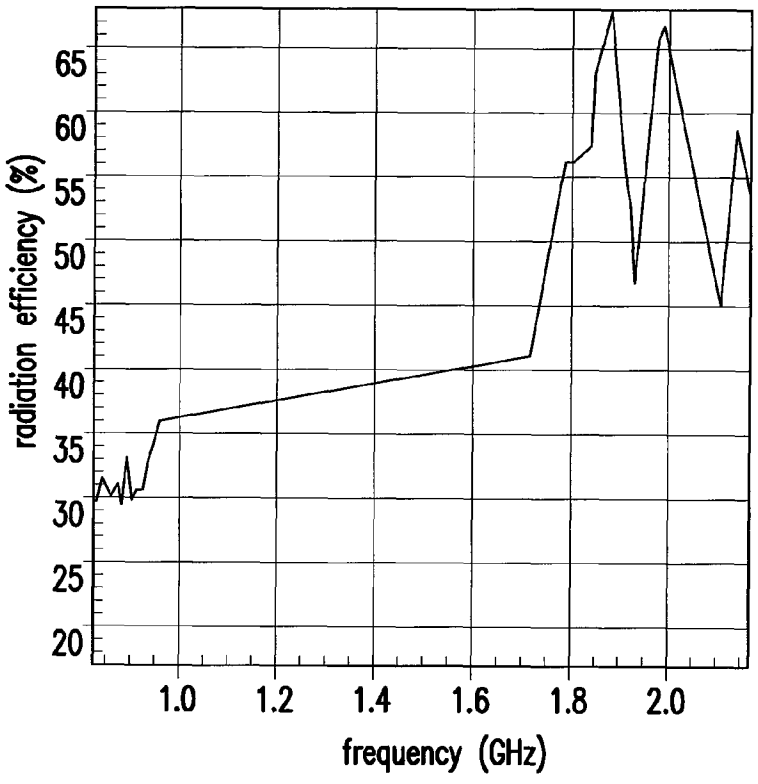

For example, FIG. 2 is a view illustrating a voltage standing wave ratio (VSWR) of the first antenna element according to an embodiment of the invention, and FIG. 3 is a view illustrating a radiation efficiency and gain of the first antenna element according to an embodiment of the invention. As shown in FIG. 2, in an embodiment, the first frequency band of the first antenna element may cover 824 MHz to 960 MHz, for example, and the second frequency band of the first antenna element may cover 1710 MHz to 2170 MHz, for example. Thus, the wearable device 100 is applicable in a wireless wide area network (WWAN) of the third generation (3G) mobile communication.

In addition, as shown in the left part of FIG. 3, a radiation efficiency of the first antenna element in a frequency band of GSM850/GSM960 in the WWAN reaches 32%, and a radiation efficiency of the first antenna element in a DCS/PCS frequency band of the WWAN reaches 55%. Besides, curves 310 to 330 in the right part of FIG. 3 respectively represent gains of the first antenna element in X-Y plane, X-Z plane, and Y-Z plane. As indicated by the curves 310 to 330, the first antenna element has higher gains in the first frequency band and the second frequency band, and thus meets the application requirement of the wearable device 100.

Figure 4:
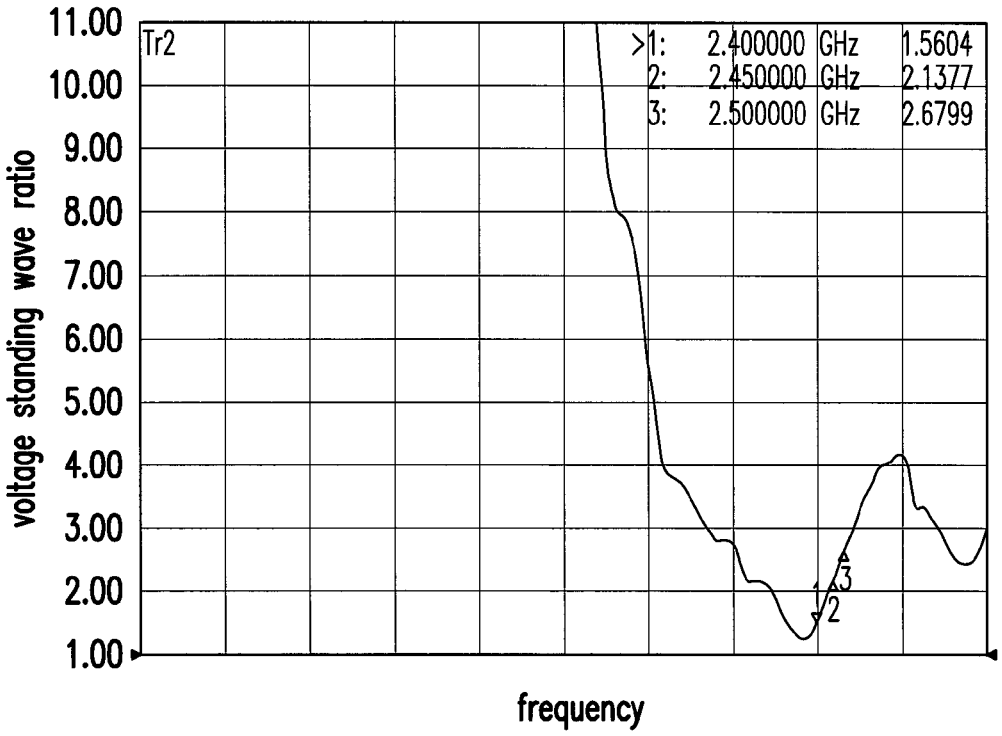
FIG. 4 is a view illustrating a voltage standing wave ratio (VSWR) of a second antenna element according to an embodiment of the invention.
Figure 5:
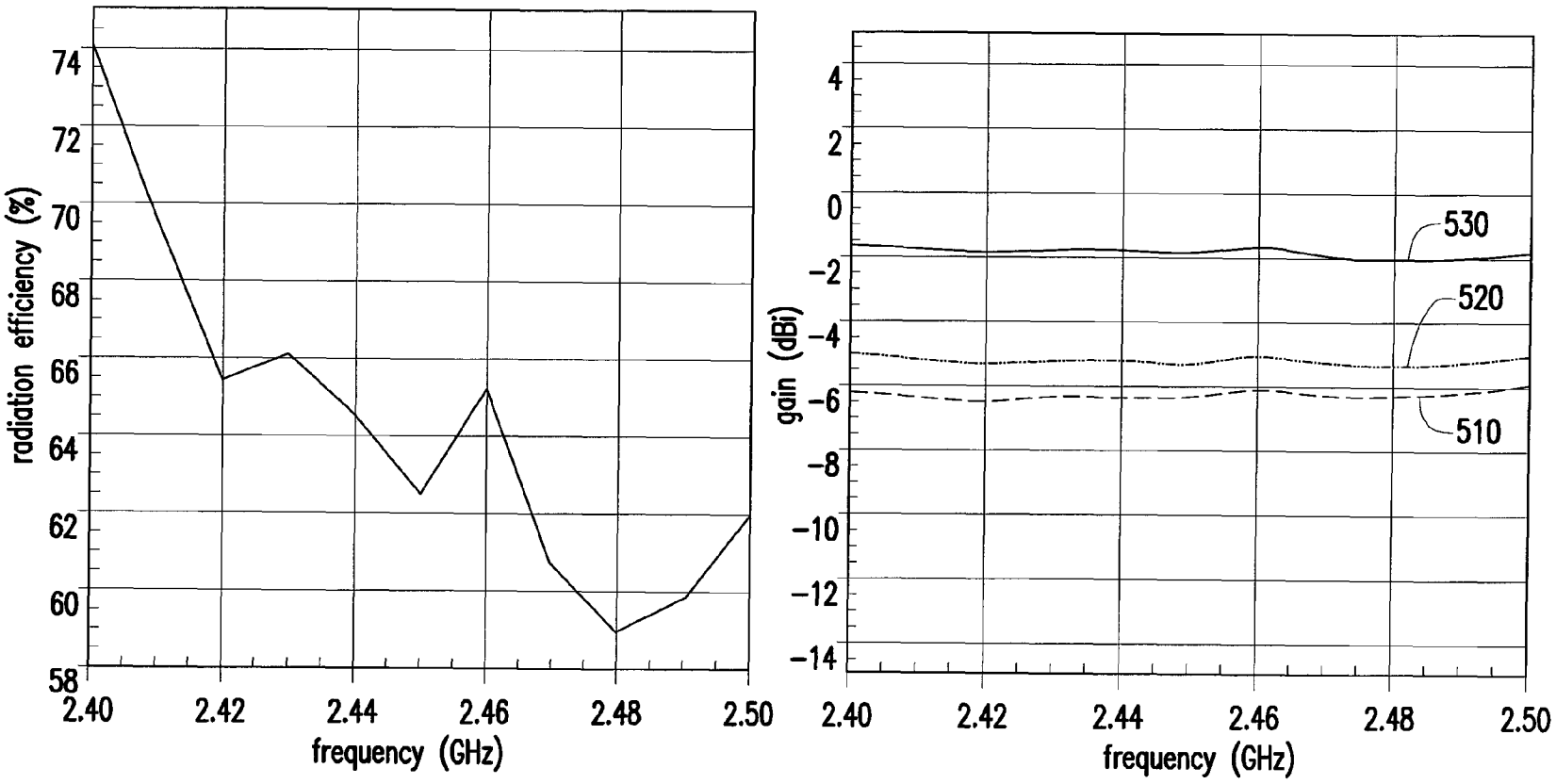
FIG. 5 is a view illustrating a radiation efficiency and gain of the second antenna element according to an embodiment of the invention.

FIG. 4 is a view illustrating a voltage standing wave ratio (VSWR) of the second antenna element according to an embodiment of the invention, and FIG. 5 is a view illustrating a radiation efficiency and gain of the second antenna element according to an embodiment of the invention. As shown in FIG. 4, in an embodiment, the third frequency band of the second antenna element may cover 2.4 GHz to 2.5 GHz, for example, and the wearable device 100 is thus applicable in the wireless fidelity (Wi-Fi) technology. In addition, as shown in the left part of FIG. 5, a radiation efficiency of the second antenna element in the third frequency band reaches 65%. Besides, curves 510 to 530 in the right part of FIG. 5 respectively represent gains of the second antenna element in X-Y plane, X-Z plane, and Y-Z plane. As indicated by the curves 510 to 530, the second antenna element has a higher gain in the third frequency band, and thus meets the application requirement of the wearable device 100.

In other words, the wearable device 100 may use the conductive frame 120 and the microstrip line 170 to form the first and second antenna elements. Therefore, it is not necessary for the wearable device 100 to be additionally disposed with an independent space to accommodate an antenna element. Thus, a hardware space of the wearable device 100 may be reduced, and a convenience of wearing the wearable device 100 is thus improved.

Figure 6:
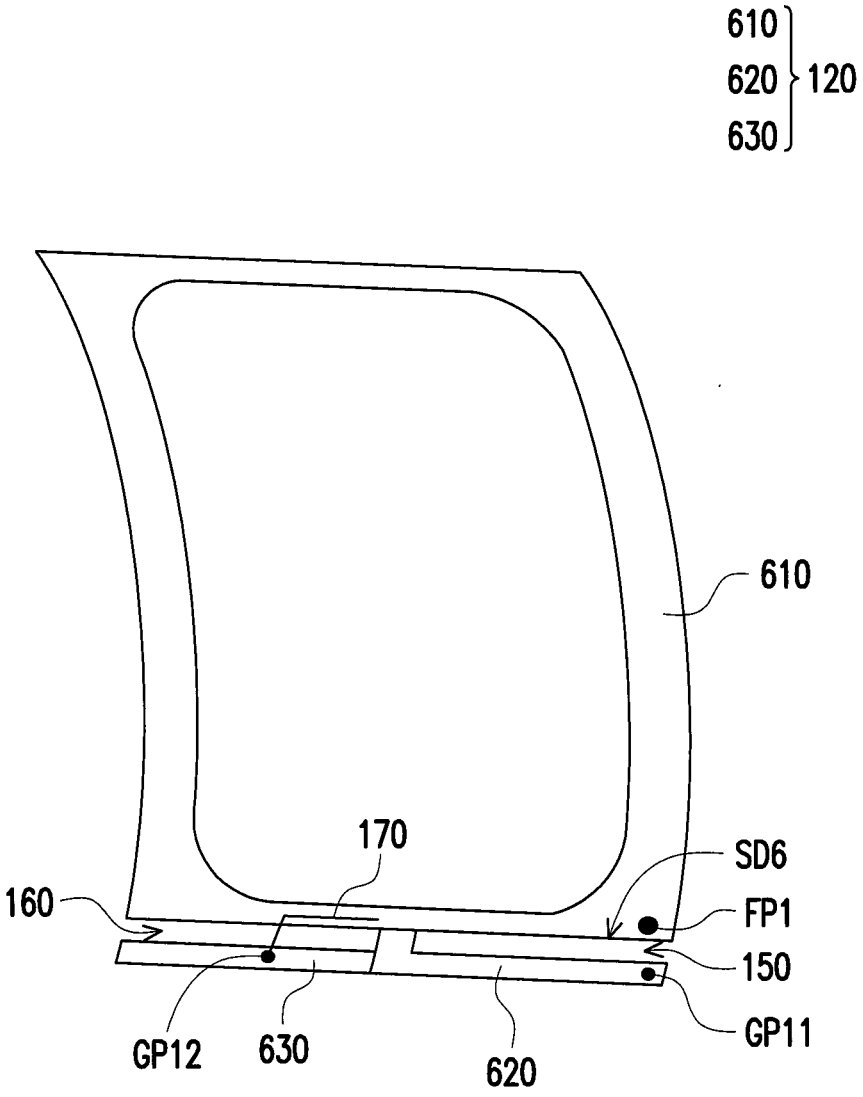
FIG. 6 is a perspective view illustrating a conductive frame and a microstrip line according to an embodiment of the invention.

To allow people having ordinary skill in the art to better understand the invention, FIG. 6, which is a perspective view illustrating the conductive frame and the microstrip line according to an embodiment of the invention, is provided. Further description about the conductive frame 120 and the microstrip line 170 is provided below with reference to FIG. 6. As shown in FIG. 6, the conductive frame 120 includes a frame body 610, a first extension element 620, and a second extension element 630. In addition, the frame body 610 surrounds the display region 101 of the display unit 110. In addition, an edge SD6 of the frame body 610 has the feeding point FP1.

One end of the first extension element 620 is electrically connected to the edge SD6 of the frame body 610, and another end of the first extension element 620 has the first ground point GP11. In addition, the first extension element 620 and the edge SD6 of the frame body 610 form the first open slot 150. Besides, the second extension element 630 is electrically connected to the first extension element 620. The second extension element 630, the first extension element 620, and the edge SD6 of the frame body 610 form the second open slot 160. A shape of the first extension element 620 may be an L shape, for example, and the second extension element 630 and the first extension element 620 may form an inverted T shape, for example. The microstrip line 170 and the conductive frame 120 are spaced by an insulator (e.g. substrate) and opposite with each other, and the second ground point GP12 of the microstrip line 170 may be electrically connected to the second extension element 630 of the conductive frame 120 through a via hole penetrating the insulator.

It should be noted that a size of the first open slot 150 is related to impedance matching of the first antenna element, and a size of the second open slot 160 is related to impedance matching of the second antenna element. In other words, people having ordinary skill in the art may modify the size of the first open slot 150, such as a width and a length of the first open slot 150, to improve a radiation characteristic of the first antenna element. Furthermore, people having ordinary skill in the art may modify a size of the second open slot 160 and a thickness of the dielectric substrate to improve a radiation characteristic of the second antenna element.

Moreover, the frame body 610 and the first extension element 620 may be configured to form the first antenna element, such as a planar inverted-F antenna, and the frame body 610 is a primary radiation body of the first antenna element. In addition, the frame body 610, the first extension element 620, the second extension element 630, and the microstrip line 170 may be configured to form the second antenna element, such as a coupled monopole antenna. In this way, the wearable device 100 may achieve the mobile communication function through the first antenna element and the second antenna element.

It should be noted that the second extension element 630 and the microstrip line 170 are disposed in correspondence with the second antenna element. Besides, in practical application, the wearable device 100 may be disposed with the first antenna element only and use the first antenna element to achieve the mobile communication function. In other words, in another embodiment, people having ordinary skill in the art may selectively remove the second extension element 630 and the microstrip line 170 that form the second antenna element according to the design requirement.

In addition, the wearable device 100 shown in FIG. 1 is a smart watch, for example. In addition, the device body 140 may be a watch body of the smart watch, for example, and the conductive frame 120 may be a watch case disposed at an external side of the watch body. In addition, the belt-like structure 130 may form a watch belt of the smart watch, and the smart watch may display relevant information such as time through the display unit 110. In other words, the smart watch may receive or emit an electromagnetic signal through the watch case (i.e. the conductive frame 120). Besides, the conductive frame 120 may be composed of a conductive material such as metals, and the smart watch may have a design with a metallic texture through the conductive frame 120.

Figure 7:
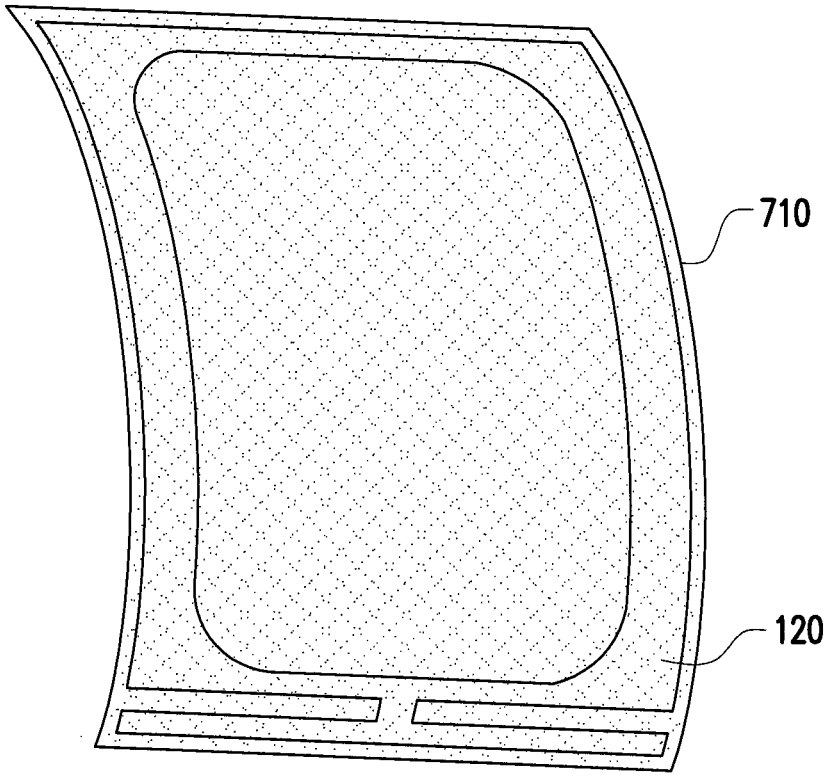
FIG. 7 is a schematic view illustrating a conductive frame and a conductive film layer according to an embodiment of the invention.

It should be noted that in another embodiment, the conductive frame 120 may be integrated into the display unit 110. For example, FIG. 7 is a schematic view illustrating a conductive frame and a conductive film layer according to an embodiment of the invention. The display unit 100 may be a liquid crystal display, for example, and the liquid crystal display includes a conductive film layer 710 for disposing a pixel electrode. In addition, as shown in FIG. 7, the conductive frame 120 may be disposed in the conductive film layer 710 in the liquid crystal display, for example.

According to the above, the wearable device of the invention uses the conductive frame surrounding the display region to form the first antenna element, and uses the conductive frame and the microstrip line to form the second antenna element. Therefore, it is not necessary for the wearable device to be additionally disposed with an independent space to accommodate an antenna element. Moreover, a hardware space of the wearable device may be reduced, and a convenience of wearing the wearable device is thus improved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A wearable device, comprising:

a display unit;

a conductive frame, having a first open slot, wherein a feeding point and a first ground point are disposed at two sides of an opening of the first open slot, and the conductive frame forms a first antenna element and comprises:

a frame body, surrounding a display region of the display unit, wherein an edge of the frame body has the feeding point; and a first extension element, wherein one end of the first extension element is electrically connected to the edge of the frame body, another end of the first extension element has the first ground point, and the first extension element and the edge of the frame body form the first open slot; and a belt-like structure, respectively connected to a first edge and a second edge of the conductive frame, the first edge and the second edge being opposite to each other.

2. The wearable device as claimed in claim 1, wherein a size of the first open slot is related to impedance matching of the first antenna element.

3. The wearable device as claimed in claim 1, wherein the conductive frame further comprises a second open slot, and the wearable device further comprises:

a microstrip line, opposite to the second open slot and having a second ground point, wherein the microstrip line and the conductive frame form a second antenna element.

4. The wearable device as claimed in claim 3, wherein a size of the second open slot is related to impedance matching of the second antenna element.

5. The wearable device as claimed in claim 1, wherein a shape of the first extension element is an L shape.

6. The wearable device as claimed in claim 1, wherein the conductive frame further comprises:

a second extension element, electrically connected to the first extension element, wherein the second extension element, the first extension element, and the edge of the frame body form a second open slot.

7. The wearable device as claimed in claim 6, wherein the first extension element and the second extension element form an inverted T shape.

8. The wearable device as claimed in claim 6, wherein the wearable device further comprises:

a microstrip line, opposite to the second open slot and electrically connected to the second extension element through a second ground point, wherein the microstrip line and the conductive frame foam a second antenna element.

9. The wearable device as claimed in claim 1, further comprising:

a first connecting element, disposed between the belt-like structure and the first edge of the conductive frame; and a second connecting element, disposed between the belt-like structure and the second edge of the conductive frame.

10. The wearable device as claimed in claim 1, wherein the conductive frame is a part of a housing of the wearable device.

11. The wearable device as claimed in claim 1, wherein the display unit is a liquid crystal display, and the conductive frame is disposed in a conductive film layer of the liquid crystal display.

12. The wearable device as claimed in claim 1, wherein the wearable device is a smart watch.

13. A wearable device, comprising:

a display unit;

a conductive frame, surrounding a display region of the display unit and having a first open slot and a second open slot, wherein a feeding point and a first ground point are disposed at two sides of an opening of the first open slot, and the conductive frame forms a first antenna element;

a microstrip line, opposite to the second open slot and having a second ground point, wherein the microstrip line and the conductive frame form a second antenna element; and a belt-like structure, respectively connected to a first edge and a second edge of the conductive frame, the first edge and the second edge being opposite to each other.

14. A wearable device, comprising:

a display unit;

a conductive frame, surrounding a display region of the display unit and having a first open slot, wherein a feeding point and a first ground point are disposed at two sides of an opening of the first open slot, and the conductive frame forms a first antenna element;

a belt-like structure, respectively connected to a first edge and a second edge of the conductive frame, the first edge and the second edge being opposite to each other;

a first connecting element, disposed between the belt-like structure and the first edge of the conductive frame; and a second connecting element, disposed between the belt-like structure and the second edge of the conductive frame.

* * * * *